US006489728B2

(12) United States Patent
Guthrie et al.

(10) Patent No.: US 6,489,728 B2
(45) Date of Patent: Dec. 3, 2002

(54) POWER EFFICIENT LED DRIVER QUIESCENT CURRENT LIMITING CIRCUIT CONFIGURATION

(75) Inventors: Don W. Guthrie, North Richland Hills, TX (US); Craig Jay Coley, Burleson, TX (US)

(73) Assignee: Aerospace Optics, Inc., Fort Worth, TX (US)

( * ) Notice: Subject to any disclaimer, the term of this patent is extended or adjusted under 35 U.S.C. 154(b) by 0 days.

(21) Appl. No.: 09/949,213

(22) Filed: Sep. 7, 2001

(65) Prior Publication Data

US 2002/0047606 A1 Apr. 25, 2002

Related U.S. Application Data

(63) Continuation-in-part of application No. 09/675,752, filed on Sep. 29, 2000, now Pat. No. 6,323,598.

(51) Int. Cl.[7] ..... H05B 37/00

(52) U.S. Cl. ..... 315/200 A; 315/291; 315/169.3; 362/800; 362/227; 323/282

(58) Field of Search ..... 315/200 A, 291, 315/164, 136, 185 R, 186, 169.3, 169.1, 62, 53, 47; 362/800, 227, 276; 323/267, 282; 250/552

(56) References Cited

U.S. PATENT DOCUMENTS 4,580,196 A * 4/1986 Task ..... 362/226
5,313,187 A 5/1994 Choi et al. ..... 340/331
5,608,290 A 3/1997 Hutchisson et al. .... 315/200 A
5,929,568 A 7/1999 Eggers ..... 315/56
5,939,839 A 8/1999 Robel et al. ..... 315/289
5,959,413 A 9/1999 Komarek et al. ..... 315/306

FOREIGN PATENT DOCUMENTS

EP 0 695 112 A1 1/1996
EP 0 890 894 A1 1/1999
EP 0 991 304 A2 4/2000

* cited by examiner

*Primary Examiner*—Haissa Philogene

(57) ABSTRACT

To prevent inadvertent illumination of a light emitting diode (or set of light emitting diodes) by stray currents at extremely low levels, a quiescent current limiting resistive load is connected in parallel with the light emitting diode, sized to conduct a desired minimum current at the lowest forward voltage drop at which the light emitting diode is expected to properly illuminate. Rather than connecting the resistive load across the input/output ports of the driver circuit, in parallel with any biasing resistance and the light emitting diode, the load is connected directly in parallel with the light emitting diode. Additional current through the quiescent current limiting resistive load as the voltage across the input/output ports increase is thus effectively capped by the maximum forward voltage drop across the light emitting diodes.

20 Claims, 1 Drawing Sheet

POWER EFFICIENT LED DRIVER QUIESCENT CURRENT LIMITING CIRCUIT CONFIGURATION

CROSS-REFERENCE TO RELATED APPLICATIONS

This application is related to and claims priority as a continuation-in-part of U.S. patent application Ser. No. 09/675,752 entitled ENHANCED TRIM RESOLUTION VOLTAGE-CONTROLLED DIMMING LED DRIVER and filed Sep. 29, 2000, now U.S. Pat. No. 6,323,598 and is also related to the subject matter of commonly assigned, co-pending U.S. patent application Ser. No. 09/949,139 entitled VOLTAGE DIMMABLE LED DISPLAY PRODUCING MULTIPLE COLORS and filed Sep. 7, 2001. The content of the above-identified applications are hereby incorporated by reference.

TECHNICAL FIELD OF THE INVENTION

The present invention is directed, in general, to driver circuits for light emitting diode illumination sources and, more specifically, to voltage-controlled dimming driver circuits for light emitting diode illumination sources employed in place of incandescent lamps within aircraft crewstation instrumentation.

BACKGROUND OF THE INVENTION

Commercial and military aircraft instrumentation displays, like many other display systems, frequently employ illuminated indicators and controls. Traditionally, incandescent lamps operating at 5 VAC, 14 VDC or 28 VDC have been employed as illumination sources for illuminated pushbutton switches, indicators and annunciators within aircraft instrumentation. The illumination from such incandescent lamps is generally optically filtered to produce a wide range of human visible or night vision imaging system (NVIS) colors, and the small size of incandescent lamps allows multiple lamps to be used within the same display to illuminate different regions of the display in different colors.

The luminance required of incandescent displays varies from approximately 400 foot-lamberts at full rated voltage for sunlight-readability in daytime flying to 15 foot-lamberts for commercial/general aviation night flying, 1.0 foot-lamberts for military night flying, and 1.0 foot-lamberts for night flying utilizing NVIS night vision goggles. Because the luminance of incandescent lamps varies with applied voltage within a certain range, output luminance levels of displays are adjusted for night flying conditions by reducing the supplied voltage to approximately one-half or less of the normal full rated operating voltage (i.e. voltage-controlled dimming).

The inherent characteristics of incandescent lamps, however, lead to noticeable chromaticity shifts as the applied voltage is reduced. Moreover, incandescent lamps suffer other disadvantages when employed in aircraft instrumentation, including high power consumption, high inrush current, uncomfortably high touch temperatures, and unreliability in high vibration environments. As a result, considerable effort has been expended to incorporate more stable, efficient and reliable technologies, such as light emitting diodes (LEDs), into aircraft crewstation illuminated displays, and to retrofit existing displays.

The use of light emitting diodes as a retrofit in illuminated displays for aircraft crewstation instrumentation generally requires connection to aircraft wiring, circuitry and systems originally designed to operate with incandescent lamps. However, light emitting diodes—unlike incandescent lamps—can produce low but detectable levels of illumination with as little as a few microamperes ($\mu$A) of current. For a variety of reasons, currents at such levels exist in aircraft wiring and avionics boxes coupled to illuminated displays when the displays are not supposed to be illuminated, and may result in inadvertent or unintentional illumination when light emitting diodes are employed as an illumination source. Experimentation has revealed that indium gallium nitride light emitting diodes (blue, green, or yellow, depending on the indium concentration, or white if packaged with phosphor) are particularly vulnerable to such inadvertent low luminance levels.

Because incandescent lamps were essentially immune to inadvertent illumination while light emitting diodes are not, additional driver circuitry is required for light emitting diodes to prevent inadvertent illumination. Requiring a minimum current of 1.0 milliamperes (mA) to illuminate the light emitting diode(s) has been determined through experimentation to be sufficient to prevent inadvertent illumination, even when a few hundred microamperes ($\mu$A) of current are unintentionally generated across the light emitting diode driver inputs.

For example, a typical light emitting diode driver circuit for employing light emitting diodes as illumination sources in retrofitting aircraft instrumentation is shown in FIG. 3. Driver 300 includes a biasing resistor R2 and a light emitting diode L1 connected in series between input and output ports ("+" and "−") to which the input voltage is applied. For an input voltage of 28 VDC, a typical resistance value for resistor R2 would be 1250 ohms (Ω), resulting in a forward voltage drop of approximately 3.0 VDC across light emitting diode L1 and a current through resistor R2 and light emitting diode L1 of approximately 20 mA. For night flying conditions, the applied input voltage across the input and output ports is reduced to a level where the forward voltage drop across light emitting diode L1 is approximately 2.37 VDC and the total circuit current is approximately 50 $\mu$A. This 50 $\mu$A circuit current is a level known to be vulnerable to inadvertent illumination, rendering the driver 300 unsuitable.

There is, therefore, a need in the art for quiescent current limiting in light emitting diode driver circuits employed for aircraft crewstation instrumentation, and particularly power efficient quiescent current limiting.

SUMMARY OF THE INVENTION

To address the above-discussed deficiencies of the prior art, it is a primary object of the present invention to provide, for use in voltage-controlled dimming light emitting diode driver, a quiescent current limiting mechanism to prevent inadvertent illumination of a light emitting diode (or set of light emitting diodes) by stray currents at extremely low levels, which is implemented in the present invention by a resistive load connected in parallel with the light emitting diode. The quiescent current limiting resistive load is sized to conduct a desired minimum current at the lowest forward voltage drop at which the light emitting diode is expected to properly illuminate. Rather than connecting the resistive load across the input/output ports of the driver circuit, in parallel with any biasing resistance and the light emitting diode, the load is connected directly in parallel with the light emitting diode. Additional current through the quiescent current limiting resistive load as the voltage across the input/output ports increase is thus effectively capped by the maximum forward voltage drop across the light emitting diodes.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

Figure 1:
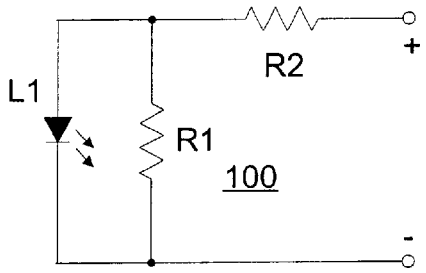
FIG. 1 depicts a circuit diagram for a voltage-controlled dimming light emitting diode driver with quiescent current limiting according to one embodiment of the present invention.
Figure 2:
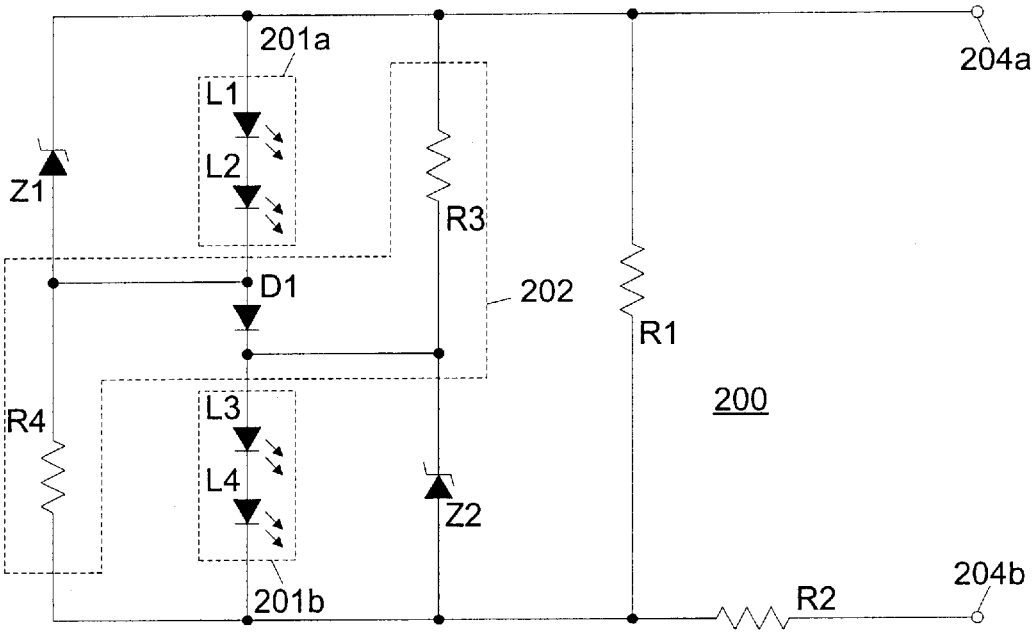
FIG. 2 depicts is a circuit diagram for a voltage-controlled dimming light emitting diode driver with quiescent current limiting according to another embodiment of the present invention.

FIGS. 1 and 2, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

Figure 3:
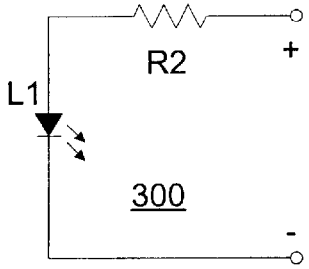
Figure 3 (Prior art)
FIG. 3 is a circuit diagram for a light emitting diode driver without quiescent current limiting.
Figure 4:
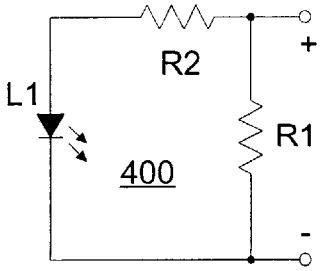
FIG. 4 is a circuit diagram for a light emitting diode driver with quiescent current limiting in an inefficient power configuration.

One rather self-evident configuration for connection of a load resistance within the unsatisfactory driver 300 shown in FIG. 3 is depicted in FIG. 4. In addition to biasing resistor R2 and light emitting diode L1 connected in series between input and output ports ("+" and "−"), driver 400 also includes a quiescent current resistor R1 connected across the input and output ports in parallel with resistor R2 and light emitting diode L1. A resistance value of 2600 ohms (Ω) will insure that driver 400 consumes 1.0 mA of total current when the applied input voltage is adjusted so that the current through the light emitting diode L1 (and resistor R2) is reduced to the night flying setting of 50 $\mu$A. Unfortunately, however, the addition of resistor R1 as shown adds an additional 10.7 mA of current when the applied input voltage is 28 VDC, the full rated voltage for the exemplary embodiment. The increase of 53.5% in overall power consumption by the driver circuit 400 over the design of FIG. 3 renders this configuration unsatisfactory.

FIG. 1 depicts a circuit diagram for a voltage-controlled dimming light emitting diode driver with quiescent current limiting according to one embodiment of the present invention. In addition to biasing resistor R2 and light emitting diode L1 connected in series between input and output ports ("+" and "−"), driver 100 also includes a quiescent current resistor R1 connected in parallel across light emitting diode L1, in series with resistor R2 between the input and output ports.

In driver 100, the resistance of resistor R1 is approximately 2370 Ω so that current through the resistor R1 is about 1 mA when the voltage drop across light emitting diode L1 and resistor R1 is 2.37 VDC, the forward voltage drop required to produce a current of 50 $\mu$A through light emitting diode L1. The resistance of biasing resistor R1 is approximately 1176 Ω to compensate for the additional circuit load.

Since the voltage drop across quiescent current limiting resistor R1 is effectively limited to the maximum forward voltage drop across the light emitting diode L1, power dissipation by resistor R1 at high input voltages is effectively capped. When the forward voltage drop across light emitting diode L1 increases to 3.0 VDC (with roughly 20 mA of current passing through light emitting diode L1), the current through quiescent current limiting resistor R1 increases only to 1.26 mA. Thus, at 28 VDC applied across the input and output ports of driver 100, the total current through the circuit is 21.26 mA, which results in only a 6.3% increase in current over the design in FIG. 3.

Accordingly, quiescent current limiting resistor R1 is preferably connected directly in parallel with the light emitting diode (or diodes, if a set of series connected LEDs is employed) in a driver circuit for a light emitting diode illumination source. Any biasing resistance should be connected in series with the parallel combination of the light emitting diode(s) and quiescent current resistor, and preferably no significant resistance should appear between a first terminal (anode) of the light emitting diode(s) and a first terminal of the quiescent current limiting resistor or between a second terminal (cathode) of the light emitting diode(s) and a second terminal of the quiescent current limiting resistor. The quiescent current limiting resistor is sized to require a desired minimum total current through the driver at the minimum forward bias voltage for illumination of the light emitting diode, and the resistance of the biasing resistor R2 is selected with consideration for the additional load represented by the quiescent current limiting resistor R1.

FIG. 2 is a circuit diagram for a voltage-controlled dimming light emitting diode driver with quiescent current limiting according to another embodiment of the present invention. Circuit 200 includes four white light emitting diodes L1–L4 series-connected in pairs L1/L2 and L3/L4 within two LED groups 201*a* and 201*b*. A switching circuit 202 is connected between LED groups 201*a* and 201*b* to switch LED groups 201*a* and 20*b* from series-connection between input and output ports 204*a* and 204*b* to parallel-connection, or vice-versa, as the voltage applied across input and output ports 204*a*–204*b* is varied across a threshold or "kickover" value.

Switching circuit 202 includes a switching diode D1 connected in series between LED groups 201*a* and 201*b*, a first resistor R3 connected in parallel with both LED group 201*a* and switching diode D1, and a second resistor R4 connected in parallel with both LED group 201*b* and switching diode D1.

The cathode of switching diode D1 is connected to the anode of the last light emitting diode L2 (in the direction of the forward voltage drop across the LEDs) within LED group 201*a* and to one end of resistor R4; the anode of switching diode D1 is connected to the cathode of the first light emitting diode L3 with LED group 201*b* and to one end of resistor R3. An opposite end of resistor R3 is connected to the cathode of the first light emitting diode L1 within LED group 201*a*, and an opposite end of resistor R4 is connected to the anode of the last light emitting diode L4 within LED group 201*b*.

LED groups 201*a* and 201*b* (comprising light emitting diode pairs L1/L2 and L3/L4) are connected by switching circuit 202 either in series or in parallel between input and output ports 204*a*–204*b*, depending on the voltage applied across the input and output ports 204*a*–204*b*. Switching circuit 202 provides kickover from parallel-connection to series-connection, and vice-versa, of LED groups 201*a*–201*b*. Switching diode D1 and resistors R3 and R4 enable the switching mechanism.

In operation, circuit 200 operates in two modes: high luminance mode above the kickover point, where the applied input voltage across ports 204*a*–204*b* is greater than the combined forward voltage drops (turn-on voltages) of light emitting diodes L1–L4 and switching diode D1; and low luminance mode below the kickover point, where the applied input voltage across ports 204*a*–204*b* is less than the combined forward voltage drops of light emitting diodes L1–L4 and switching diode D1 (but greater than the combined forward voltage drops of either of light emitting diode pairs l1/L2 or L3/L4).

In high luminance mode, switching diode D1 conducts, and most of the current between ports 204*a*–204*b* passes through the series connected path of light emitting diode pair L1/L2, switching diode D1, and light emitting diode L3/L4. The primary current path for high luminance control is established by the high luminance resistor R2.

In low luminance mode, switching diode D1 stops conducting and the current passes through the two parallel paths comprising: light emitting diode pair L1/L2 and resistor R4; and resistor R3 and light emitting diode pair L3/L4. Low luminance mode therefore results when the applied input voltage is insufficient to allow forward current to flow through switching diode D1. The primary current path for low luminance control is established by low luminance resistors R3–R4.

Zener diodes Z1 and Z2, in conjunction with high luminance resistor R2, provide circuit protection against transients, conducted electromagnetic susceptibility, or an electrostatic discharge event. Zener diodes Z1 and Z2 also prevent failure of the entire set of light emitting diodes L1–L4 should a single light emitting diode L1–L4 fail in an electrically open state, providing an alternate current path to maintain circuit integrity with two light emitting diodes still illuminating under such a catastrophic failure condition.

In addition to setting the kickover point as a function of input voltage applied across ports 204*a*–204*b*, resistor R2 serves to limit the current of a transient or overvoltage event and also serves to limit the operating current to safe levels in order to prevent a catastrophic failure of the display circuitry.

Exemplary values for the relevant components depicted in FIG. 2 are: resistor R1=4.32 kiloohms (KΩ); resistor R2=1.5 KΩ; resistors R3 and R4=20 KΩ; and light emitting diodes L1–l4 each having forward voltage drops in the range 2.5–3.3 VDC.

Resistor R1 provides a quiescent current path to prevent false or unintentional illumination at low current levels, which otherwise may produce detectable illumination at levels of as low as a few microamperes (μA). Resistor R1 is located to allow the rise in current across the resistor with applied voltage to halt at the combined forward voltage drops of light emitting diodes L1–L4 and switching diode D1, reducing unnecessary power dissipation at higher input voltages.

As described above, quiescent current limiting resistor R1 is connected directly in parallel with light emitting diodes L1–L4. No significant resistances appears in series between either terminal of resistor R1 and the corresponding connected terminal of light emitting diode series L1–L4. The presence of additional resistances R3 and R4 also connected in parallel with light emitting diode pairs L1/L2 and L3/L4 does not significantly detract from the power efficiency. improvements of connecting resistor R1 as shown rather than directly across the input and output ports 204*a* and 204*b*.

In the configuration shown, the additional current draw over a design lacking quiescent current limiting resistor R1 is the combined forward voltage drops of light emitting diodes L1–L4 and switching diode D1 divided by the resistance of resistor R1. Power dissipation by resistor R1 therefore does not scale with increases in voltage across the input and output ports, but is instead effectively capped by the maximum forward voltage drop across the light emitting diode(s) employed to provide illumination.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention it its broadest form.

What is claimed is:

1. For use in an illumination source, a light emitting diode driver for limiting quiescent current comprising:

at least one light emitting diode connected between an input port and an output port;

a biasing resistor connected in series with the at least one light emitting diode between the input and output ports; and a quiescent current limiting resistor connected directly in parallel with the at least one light emitting diode and in series with the biasing resistor between the input and output ports, the quiescent current limiting resistor sized to require a selected minimum current between the input and output ports at a first forward voltage drop across the at least one light emitting diode.

2. The driver as set forth in claim 1 wherein a first terminal of the quiescent current limiting resistor and a cathode of the at least one light emitting diode are both connected to a first node and a second terminal of the quiescent current limiting resistor and an anode of the at least one light emitting diode are both connected to a first node.

3. The driver as set forth in claim 1 wherein the at least one light emitting diode further comprises:

a group of light emitting diodes connected in series with a common forward bias orientation from a first light emitting diode within the group to a last light emitting diode within the group, wherein a first terminal of the quiescent current limiting resistor and a cathode of the first one light emitting diode are both connected to a first node and a second terminal of the quiescent current limiting resistor and an anode of the last light emitting diode are both connected to a first node.

4. The driver as set forth in claim 1 wherein the quiescent current limiting resistor is connected in parallel with the at least one light emitting diode without resistors connected in series between terminals of the quiescent current limiting resistor and the at least one light emitting diode.

5. The driver as set forth in claim 4 further comprising:

additional devices including at least one resistance connected in parallel with the quiescent current limiting resistor and the at least one light emitting diode.

6. The driver as set forth in claim 1 wherein current through the quiescent current limiting resistor is constrained by a forward voltage drop for the at least one light emitting diode at a maximum current through the at least one light emitting diode.

7. The driver as set forth in claim 1 wherein the selected minimum current prevents inadvertent illumination of the at least one light emitting diode.

8. For use with a light emitting diode illumination source, a method for limiting quiescent current comprising:

applying a voltage across an input port and an output port of a light emitting diode driver circuit to drive:

at least one light emitting diode connected between the input port and the output port;

a biasing resistor connected in series with the at least one light emitting diode between the input and output ports; and a quiescent current limiting resistor connected directly in parallel with the at least one light emitting diode and in series with the biasing resistor between the input and output ports, the quiescent current limiting resistor sized to require a selected minimum current between the input and output ports at a first forward voltage drop across the at least one light emitting diode.

9. The method as set forth in claim 8 wherein a first terminal of the quiescent current limiting resistor and a cathode of the at least one light emitting diode are both connected to a first node and a second terminal of the quiescent current limiting resistor and an anode of the at least one light emitting diode are both connected to a first node.

10. The method as set forth in claim 8 wherein the at least one light emitting diode further comprises:

a group of light emitting diodes connected in series with a common forward bias orientation from a first light emitting diode within the group to a last light emitting diode within the group, wherein a first terminal of the quiescent current limiting resistor and a cathode of the first one light emitting diode are both connected to a first node and a second terminal of the quiescent current limiting resistor and an anode of the last light emitting diode are both connected to a first node.

11. The method as set forth in claim 8 wherein the quiescent current limiting resistor is connected in parallel with the at least one light emitting diode without resistors connected in series between terminals of the quiescent current limiting resistor and the at least one light emitting diode.

12. The method as set forth in claim 11 wherein the step of applying a voltage across an input port and an output port of a light emitting diode driver circuit further comprises:

driving additional devices including at least one resistance connected in parallel with the quiescent current limiting resistor and the at least one light emitting diode.

13. The method as set forth in claim 8 wherein current through the quiescent current limiting resistor is constrained by a forward voltage drop for the at least one light emitting diode at a maximum current through the at least one light emitting diode.

14. The method as set forth in claim 8 wherein the selected minimum current prevents inadvertent illumination of the at least one light emitting diode.

15. A circuit for voltage-controlled dimming of light emitting diodes comprising:

first and second light emitting diode groups connected between an input port and an output port;

a switching circuit coupled to the first and second light emitting diode groups, wherein the switching circuit switches the first and second light emitting diode groups between series-connection and parallel-connection; and a quiescent current limiting resistor connected directly in parallel with the first and second light emitting diode groups between the input and output ports, the quiescent current limiting resistor sized to require a selected minimum current between the input and output ports at a first forward voltage drop across the first and second light emitting diode groups.

16. The circuit as set forth in claim 15 wherein the switching circuit further comprises:

a switching diode connected in series between the first and second light emitting diode groups;

a first resistor connected in parallel with the switching diode and the first light emitting diode group; and a second resistor connected in parallel with the switching diode and the second light emitting diode group, wherein the quiescent current limiting resistor is connected in parallel with the switching diode and the first and second resistors.

17. The circuit as set forth in claim 16 wherein the first and second light emitting diode groups each comprise a plurality of light emitting diodes connected in series such that the first and second light emitting diode groups and the switching diode form a set of series-connected diodes with a common forward bias orientation from a first diode to a last diode within the set, and wherein a first terminal of the quiescent current limiting resistor is connected to a cathode of the first diode within the set and a second terminal of the quiescent current limiting resistor is connected to an anode of the last diode within the set.

18. The circuit as set forth in claim 15 further comprising:

a biasing resistor connected in series with the first and second light emitting diode groups and the quiescent current limiting resistor between the input and output ports.

19. The circuit as set forth in claim 15 wherein current through the quiescent current limiting resistor is constrained by a combined forward voltage drop at a maximum current for all light emitting diodes within the first and second light emitting diode groups plus a voltage drop across the switching circuit.

20. The circuit as set forth in claim 15 wherein the selected minimum current prevents inadvertent illumination of light emitting diodes within the first and second light emitting diode groups.

* * * * *